US005651253A

United States Patent [19]

Althaus et al.

[11] Patent Number: 5,651,253

[45] Date of Patent: Jul. 29, 1997

[54] APPARATUS FOR COOLING A GAS TURBINE COMBUSTION CHAMBER

[75] Inventors: Rolf Althaus, Kobe, Japan; Jakob J. Keller, Redmond, Wash.; Burkhard Schulte-Werning, Basel, Switzerland

[73] Assignee: ABB Management AG, Baden, Switzerland

[21] Appl. No.: 699,731

[22] Filed: Aug. 20, 1996

Related U.S. Application Data

[62] Division of Ser. No. 323,688, Oct. 17, 1994.

[30] Foreign Application Priority Data

Oct. 18, 1993 [DE] Germany ..... 43 35 413.0

[51] Int. Cl.[6] ..... F23R 3/02

[52] U.S. Cl. ..... 60/752

[58] Field of Search ..... 60/752, 755, 756, 60/757

[56] References Cited

U.S. PATENT DOCUMENTS

| | | | |
|---|---|---|---|
| 2,644,302 | 7/1953 | Kidd | 60/752 |
| 3,408,812 | 11/1968 | Stenger . | |
| 3,777,484 | 12/1973 | Dibelius et al. . | |
| 4,071,194 | 1/1978 | Eckert et al. . | |
| 4,292,376 | 9/1981 | Hustler . | |
| 4,302,941 | 12/1981 | DuBell . | |
| 4,339,925 | 7/1982 | Eggmann et al. . | |
| 4,446,693 | 5/1984 | Pidcock et al. . | |
| 4,607,487 | 8/1986 | Tilston | 60/752 |
| 4,653,279 | 3/1987 | Reynolds . | |
| 4,773,227 | 9/1988 | Chabis . | |
| 5,027,604 | 7/1991 | Krueger . | |
| 5,226,278 | 7/1993 | Meylan et al. . | |
| 5,246,341 | 9/1993 | Hall et al. . | |
| 5,363,654 | 11/1994 | Lee | 60/752 |

FOREIGN PATENT DOCUMENTS

| | | |
|---|---|---|
| 0202050 | 11/1986 | European Pat. Off. . |
| 0244693 | 4/1987 | European Pat. Off. . |
| 0225527 | 6/1987 | European Pat. Off. . |
| 0489193 | 10/1992 | European Pat. Off. . |
| 1952436 | 10/1969 | Germany . |
| 2907918 | 3/1979 | Germany . |
| 3143394 | 11/1981 | Germany . |
| 23508 | 6/1913 | Norway . |
| 2077635 | 12/1981 | United Kingdom . |

*Primary Examiner*—Charles G. Freay

*Attorney, Agent, or Firm*—Burns, Doane, Swecker & Mathis, L.L.P.

[57] ABSTRACT

In a gas turbine combustion chamber cooled by means of impingement and convection cooling or pure convection cooling, a compensating flow of the cooling air is guided between adjacent cooling ducts (2) in such a way that the flow velocity in the cooling duct (2) always exceeds a critical limiting value even downstream of a local damage location (6) so that the temperature is less than a critical limiting value. The compensating flow is led past the combustion chamber outer wall. Connecting openings (5) are arranged between adjacent cooling ducts (2) and are respectively offset on the opposite sides of the cooling duct (2).

4 Claims, 1 Drawing Sheet

APPARATUS FOR COOLING A GAS TURBINE COMBUSTION CHAMBER

This application is a divisional of application Ser. No. 08/323,688, filed Oct. 17, 1996, pending.

BACKGROUND OF THE INVENTION

1. Field of the Invention

The invention relates to a method and an appliance for cooling a gas turbine combustion chamber cooled by means of impingement and convection cooling or pure convection cooling.

2. Discussion of Background

In modern gas turbine combustion chambers, cooling methods which require little or, indeed, no cooling air are increasingly being used. Because $NO_X$ emissions have to be avoided as far as possible, efforts are made to pass as much air as possible through the burner. For this reason, combinations of impingement and convection cooling systems or pure convection cooling systems are employed with ever increasing frequency. In the case of an unfavorable design, such systems can have the problematic property that small primary damage, for example a small hole in the combustion chamber wall, can lead to very large consequential damage which endangers the operation of the gas turbine. As an example, a hole in a cooling duct can lead to the cooling duct being inadequately supplied with air downstream of the hole. This can lead to damage to the whole duct downstream of the hole or even to more extensive damage.

SUMMARY OF THE INVENTION

The invention attempts to avoid all these disadvantages and, accordingly, one object of the invention is to provide, in a gas turbine combustion chamber cooled by means of impingement and convection cooling or pure convection cooling, a novel method and an appliance for cooling, which method and appliance make it possible to prevent a further increase in the damage when fairly small local damage, for example holes, occurs in the cooling duct.

This is achieved in the invention, in a method for cooling the gas turbine combustion chamber as described, by guiding a compensating flow of the cooling air between the cooling ducts in such a way that the flow velocity in the damaged cooling duct always exceeds a critical limiting value downstream of the damage location so that the temperature is less than a critical limiting temperature.

This is achieved in the invention, in an appliance for cooling the gas turbine combustion chamber, by arranging connecting openings between adjacent cooling ducts, the connecting openings being respectively offset on the opposite sides of the cooling duct.

The advantages of the invention may, inter alia, be seen in that a chain reaction is avoided when local damage occurs in the cooling duct and "self-healing" of the damaged cooling duct takes place.

It is particularly expedient for the compensating flow to be guided along the combustion chamber outer wall because cooling film flows then form on the outer wall and these cool the outer wall intensively and completely in the region of the damage location.

It is, furthermore, advantageous for the web lengths and the opening lengths of the connecting openings to be equally large because favorable cooling relationships are achieved by this means.

Finally, the connecting openings are advantageously provided in the cooling ribs.

It is expedient for the connecting openings between the cooling ducts to be dimensioned in such a way that the product of the average opening width and the cooling duct length, referred to the cross-sectional area of the cooling duct, is located in the range between 2 and 8. The most effective cooling can then be achieved.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which show an embodiment example of the invention using a sealed gas turbine combustion chamber and wherein.

DESCRIPTION OF THE PREFERRED EMBODIMENTS

Figure 1:
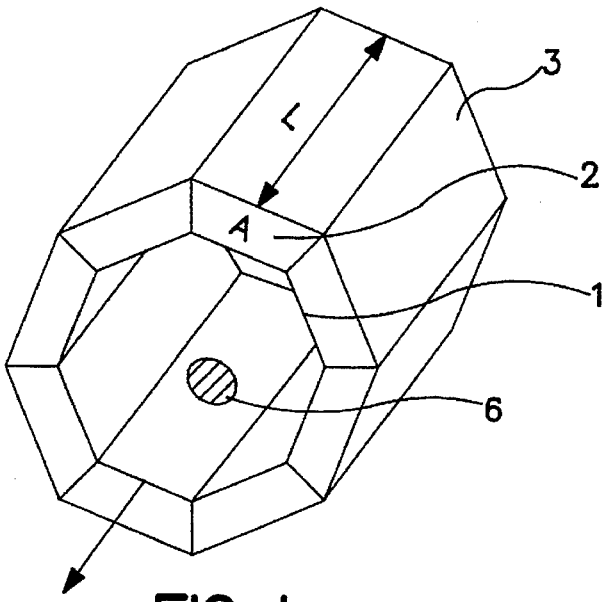
FIG. 1 shows a simplified perspective representation of the gas turbine combustion chamber.

Referring now to the drawings, wherein only the elements essential to understanding the invention are shown, wherein the flow direction of the cooling air is indicated by arrows and wherein like reference numerals designate identical or corresponding parts throughout the several views, the invention is explained in more detail below using an embodiment example and FIGS. 1 to 3.

Figure 2:
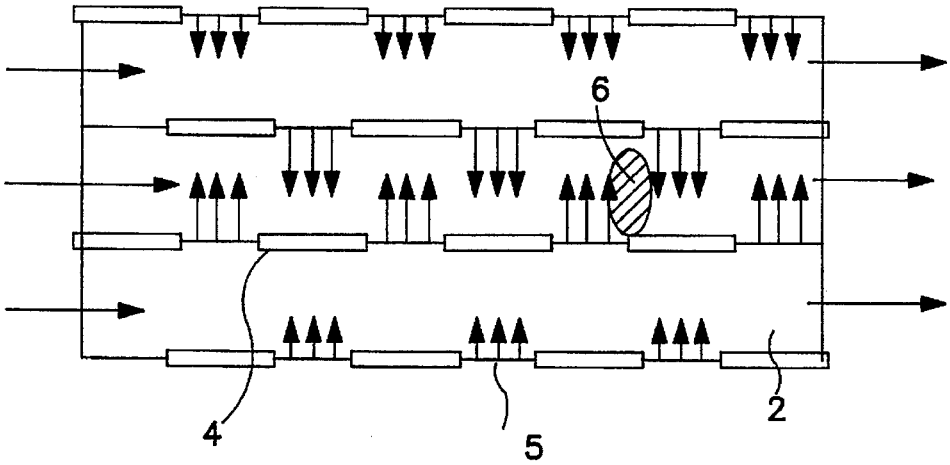
FIG. 2 shows a part of the cooling ducts of the combustion chamber.

A gas turbine combustion chamber is represented in a simplified manner in FIG. 1. A convection cooling system is used for cooling the combustion chamber wall 1. The whole of the cooling air flows along in cooling ducts 2 between the outer wall 3 and the combustion chamber wall 1 before it is supplied to the combustion chamber as combustion air. As may be seen from FIG. 2, cooling ribs 4 are located between the cooling ducts 2 and connecting openings 5, according to the invention, are present in these cooling ribs 4. These connecting openings 5 are arranged respectively offset on the opposite sides of a cooling duct 2.

Figure 3:
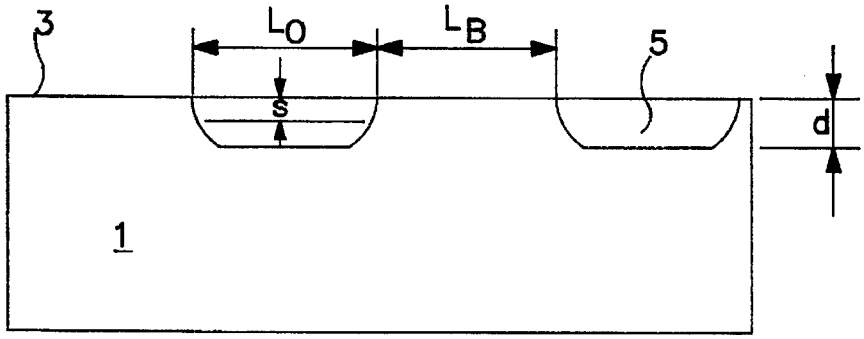
FIG. 3 shows a longitudinal section through a cooling duct.

FIG. 3 shows, in a partial longitudinal section, that the web length $L_B$ and the opening length $L_O$ are of approximately equal size. The average gap width s between two adjacent cooling ducts 2 is given by the equation $$s=\frac{L_O d}{L_O+L_B}$$

where d=width of the opening $L_O$=opening length $L_B$=web length

The dimensioning of the connecting openings 5 between the cooling ducts 2 advantageously takes place in accordance with the design rule $$2<sL/A<8,$$

i.e. the product of the average opening width s between two cooling ducts 2 and the cooling duct length L, referred to the cross-sectional area A of the cooling duct 2, is located in the range greater than 2 and smaller than 8. If the product is less than the lower limit of this interval, a very large hole can lead to overheating of the cooling duct 2 downstream of the hole. If the upper value is markedly exceeded, a very large hole or a longitudinal slot in one or more cooling ducts can lead to such a high loss of air that the burners locally overheat the primary zone of the combustion chamber during full-load operation.

During operation of the gas turbine combustion chamber, local material damage can occur in the cooling ducts, for example a local damage location 6 in the form of a small hole can form in the combustion chamber wall 1. In conventional gas turbine combustion chambers, which are cooled by combined impingement and convection cooling systems or by pure convection cooling systems in accordance with the prior art, the danger then exists that this small damage location 6 may lead to large consequential damage because the cooling duct 2 is no longer adequately supplied with cooling air downstream of the hole.

This chain reaction is prevented, however, in the present embodiment example according to the invention because a compensating flow is generated between the cooling ducts 2 by the connecting openings 5 and this leads to the effect that the flow velocity of the cooling air in the damaged cooling duct 2 is never less than a critical limiting value even downstream of the local damage location 6 which ensures that the temperature cannot exceed a critical limiting value.

The offset arrangement of the connecting openings 5 ensures that air from at least one adjacent duct can flow into the damaged cooling duct 2 at each axial position. The compensating flow then takes place on the combustion chamber outer wall 3.

Should a hole be present in the combustion chamber inner wall 1, cooling film flows form along the outer wall 3 and these cool the cooling duct 2, and particularly the outer wall 3, intensively and completely in the region of the local damage location 6 (hole). Further growth of the hole can be avoided by this means. "Self-healing" of the damaged cooling duct takes place. The invention is of particularly great importance in the case of thin combustion chamber walls with high thermal loads.

Obviously, numerous modifications and variations of the present invention are possible in light of the above teachings. It is therefore to be understood that within the scope of the appended claims, the invention may be practised otherwise than as specifically described herein.

What is claimed as new and desired to be secured by Letters Patent of the United Sates is:

1. An appliance for cooling inner and outer walls of a combustion chamber to compensate for local damage to a wall of the combustion chamber, comprising:

a plurality of separate cooling air ducts disposed between inner and outer walls to guide cooling air longitudinally along the walls;

wherein connecting openings are arranged between adjacent cooling ducts to permit cooling air to flow between adjacent cooling ducts, and wherein connecting openings communicating from opposite sides of each cooling duct are mutually offset in the longitudinal direction.

2. The appliance as claimed in claim 1, wherein the connecting openings have a predetermined longitudinal length, and the connecting openings are longitudinally spaced a distance substantially equal to the longitudinal length of the connecting openings.

3. The appliance as claimed in claim 1, wherein the cooling ducts are separated by cooling ribs and the connecting openings are formed in the cooling ribs.

4. The appliance as claimed in claim 1, wherein the connecting openings between adjacent cooling ducts have a predetermined width selected so that a product of an average connecting opening width and a cooling duct length divided by a cross-sectional area of the cooling duct is in a range greater than 2 and less than 8.

* * * * *